US006994763B2

(12) United States Patent
Austin

(10) Patent No.: US 6,994,763 B2
(45) Date of Patent: Feb. 7, 2006

(54) ELASTOMERIC MULTICOMPONENT FIBERS, NONWOVEN WEBS AND NONWOVEN FABRICS

(75) Inventor: Jared A. Austin, Greer, SC (US)

(73) Assignee: Advanced Design Concept GmbH, Hanover (DE)

( * ) Notice: Subject to any disclaimer, the term of this patent is extended or adjusted under 35 U.S.C. 154(b) by 0 days.

(21) Appl. No.: 10/692,313

(22) Filed: Oct. 23, 2003

(65) Prior Publication Data

US 2004/0214498 A1 Oct. 28, 2004

Related U.S. Application Data

(60) Provisional application No. 60/420,949, filed on Oct. 24, 2002.

(51) Int. Cl.
*D01F 8/04* (2006.01)
*D01F 8/06* (2006.01)
*D04H 3/00* (2006.01)

(52) U.S. Cl. ..... 156/181; 156/229; 264/290.5; 264/291

(58) Field of Classification Search ..... 156/180–181, 156/229, 148; 264/288.4, 290.5, 291; 442/328, 442/329, 361–362, 364
See application file for complete search history.

(56) References Cited

U.S. PATENT DOCUMENTS

| | | | | |
|---|---|---|---|---|
| 3,338,002 A | | 8/1967 | Kinney | 264/24 |
| 3,575,782 A | | 4/1971 | Hansen | 161/141 |
| 3,692,613 A | | 9/1972 | Pederson | 156/498 |
| 3,802,817 A | | 4/1974 | Matsuki et al. | 425/66 |
| 3,849,241 A | | 11/1974 | Butin et al. | 161/169 |
| 4,209,563 A | * | 6/1980 | Sisson | 442/329 |
| 4,405,297 A | | 9/1983 | Appel et al. | 425/72 |
| 4,663,221 A | | 5/1987 | Makimura et al. | 428/224 |
| 4,720,415 A | | 1/1988 | Vander Wielen et al. | 428/152 |
| 4,775,579 A | | 10/1988 | Hagy et al. | 428/284 |
| 4,789,699 A | | 12/1988 | Kieffer et al. | 524/271 |
| 4,812,112 A | | 3/1989 | Balk | 425/66 |
| 5,156,793 A | | 10/1992 | Buell et al. | 264/288.8 |
| 5,162,074 A | | 11/1992 | Hills | 156/644 |
| 5,164,262 A | | 11/1992 | Kobayashi et al. | 428/373 |
| 5,171,633 A | | 12/1992 | Muramoto et al. | 428/374 |
| 5,244,482 A | | 9/1993 | Hassenboehler, Jr. et al. | 55/528 |

(Continued)

FOREIGN PATENT DOCUMENTS

JP 61194221 8/1986

(Continued)

OTHER PUBLICATIONS

Jared Austin, *Stretching the Limits—Elastic Nonwovens Overview*, (Oct. 24, 2001).

(Continued)

*Primary Examiner*—Sam Chuan Yao
(74) *Attorney, Agent, or Firm*—O'Keefe, Egan & Peterman, LLP

(57) ABSTRACT

A bonded web of multi-component strands that include a first polymeric component and a second polymeric component is capable of overcoming a number of problems associated with nonwoven webs including both stickiness and blocking. The first polymeric component and second polymeric component are arranged in substantially distinct zones extending longitudinally along at least a portion of a length of the strands which make up the web with the second component containing a zone constituting at least a portion of the peripheral surface of the strand. The first polymeric component also has an elasticity which is greater than that of the second polymer component. A process producing elastomeric spunbonded nonwoven fabrics which utilizes the activation by incremental stretching of the strands is also provided.

11 Claims, 5 Drawing Sheets

U.S. PATENT DOCUMENTS

| | | | | |
|---|---|---|---|---|
| 5,290,626 | A | 3/1994 | Nishio et al. | 428/224 |
| 5,308,697 | A | 5/1994 | Muramoto et al. | 428/373 |
| 5,352,518 | A | 10/1994 | Muramoto et al. | 428/373 |
| 5,382,400 | A | 1/1995 | Pike et al. | 264/168 |
| 5,405,682 | A | 4/1995 | Shawyer et al. | 428/221 |
| 5,418,045 | A | 5/1995 | Pike et al. | 428/198 |
| 5,422,172 | A * | 6/1995 | Wu | 442/62 |
| 5,545,464 | A | 8/1996 | Stokes | 428/198 |
| 5,594,080 | A | 1/1997 | Waymouth et al. | 526/126 |
| 5,665,300 | A | 9/1997 | Brignola et al. | 264/555 |
| 5,814,569 | A | 9/1998 | Suzuki et al. | 442/328 |
| 5,851,935 | A | 12/1998 | Srinivasan et al. | 442/328 |
| 5,861,074 | A | 1/1999 | Wu | 156/229 |
| 5,895,710 | A | 4/1999 | Sasse et al. | 442/334 |
| 5,899,785 | A | 5/1999 | Groten et al. | 442/334 |
| 5,935,883 | A | 8/1999 | Pike | 442/340 |
| 5,952,252 | A | 9/1999 | Shawver et al. | 442/407 |
| 5,997,989 | A | 12/1999 | Gessner et al. | 428/152 |
| 6,048,613 | A | 4/2000 | Yamakawa et al. | 428/364 |
| 6,114,263 | A | 9/2000 | Benson et al. | 442/394 |
| 6,200,669 | B1 | 3/2001 | Marmon et al. | 428/198 |
| 6,225,243 | B1 * | 5/2001 | Austin | 442/361 |
| 6,228,490 | B1 | 5/2001 | Nagano et al. | 428/370 |
| 6,248,445 | B1 | 6/2001 | Yamakawa et al. | 428/373 |
| 6,255,236 | B1 | 7/2001 | Cree et al. | 442/328 |
| 6,352,948 | B1 | 3/2002 | Pike et al. | 442/384 |
| 6,525,157 | B2 | 2/2003 | Cozewith et al. | 526/348 |
| 2001/0038912 | A1 | 11/2001 | Billarant et al. | 428/364 |

FOREIGN PATENT DOCUMENTS

| | | |
|---|---|---|
| JP | HEI-4-316609 | 11/1992 |
| JP | HEI-5-131580 | 5/1993 |
| JP | 8-102319 | 4/1996 |
| JP | 09291454 | 11/1997 |
| WO | 99/17926 | 4/1999 |
| WO | 00/20178 | 4/2000 |
| WO | 00/44556 | 8/2000 |
| WO | 03/040201 | 5/2003 |
| WO | 2004/038085 A3 | 5/2004 |

OTHER PUBLICATIONS

PCT Search Report13 PCT/US03/33629, dated May 28, 2004.

* cited by examiner

CROSS DIRECTION

ELASTOMERIC MULTICOMPONENT FIBERS, NONWOVEN WEBS AND NONWOVEN FABRICS

This application claims priority to provisional application Ser. No. 60/420,949, filed Oct. 24, 2002, incorporated herein by reference.

FIELD OF THE INVENTION

The invention relates to nonwoven fabrics produced from multi-component strands, processes for producing nonwoven webs and products using the nonwoven webs. The nonwoven webs of the invention can be produced from multi-component strands including at least two components, a first, elastic polymeric component and a second, extensible but less elastic polymeric component.

BACKGROUND OF THE INVENTION

In recent years there has been a dramatic growth in the use of nonwovens, particularly elastomeric nonwovens, in disposable hygiene products. For example, elastic nonwoven fabrics have been incorporated into bandaging materials, garments, diapers, support clothing, and feminine hygiene products. The incorporation of elastomeric components into these products provides improved fit, comfort and leakage control.

However, many laminates composed of an elastic film bonded to one or two non-elastic nonwoven layer or layers must be "activated" to provide suitable tensile and recovery properties. In particular, many of these elastic film/non-elastic nonwoven laminates must be subjected to an initial drawing or stretching process to develop their ultimate properties. Traditional stretching equipment associated with wide web products include conventional draw rolls and tenter frames. Unfortunately, draw rolls can impart non-uniform stretching when used in conjunction with elastomeric fabrics. Tenter frames are expensive and require a significant amount of space within manufacturing facilities.

The present inventors have recognized that there remains a need in the art for elastomeric nonwoven fabrics exhibiting improved drape and which further may be produced economically.

SUMMARY OF THE INVENTION

The present invention is based, at least in part, on the surprising discovery that bonded webs made from a plurality of strands comprising at least two polymeric components where one component is elastic and another component is less elastic but extensible wherein the bonded nonwoven web has been subjected to incremental stretching, can overcome a variety of problems in the field.

The present invention is generally directed to methods for producing elastic nonwoven webs and fabrics that may include melt spinning a plurality of multicomponent strands having first and second polymer components longitudinally coextensive along the length of the filament. The first component is formed from an elastomeric polymer and the second component is formed from a non-elastomeric polymer. The melt spun strands are formed into a nonwoven web which is subsequently bonded and incrementally stretched in at least one direction to activate the elastic properties of the nonwoven web. Incremental stretching is accomplished by supporting a web at closely spaced apart locations and then stretching the unsupported segments of the web between these closely spaced apart locations. This is most easily accomplished by passing the web through a nip formed between a pair of meshing corrugated rolls, which have an axis of rotation perpendicular to the direction of web travel. Incremental stretching apparatuses designed for machine direction, cross direction, and diagonal stretching are described in U.S. Pat. No. 5,861,074, incorporated herein by reference. The incremental stretching step may include stretching the web so that portions of the multicomponent strands are stretch-activated and become elastic, while other portions of the strands are not stretch activated and are substantially less elastic. In advantageous embodiments, the web is incrementally stretched so that substantially all of the multicomponent strands are uniformly stretch-activated and become elastic.

In further beneficial aspects, the incremental stretching step includes incrementally stretching the web in both the machine direction and the cross-machine direction. In one embodiment, the incremental stretching may be accomplished by directing the web through at least one pair of interdigitating stretching rollers at a temperature less than about 35° C. In one aspect of such embodiments, the interdigitating stretching rollers give rise to narrow, spaced apart longitudinally extending stretch-activated elastic zones within the fabric, separated by intervening longitudinally extending non-activated zones that are substantially less elastic. In beneficial aspects of the invention, the incremental stretching may be accomplished by directing an incrementally stretched web through a second pair of interdigitating stretching rollers at a temperature less than about 35° C. to stretch activate a second portion of the non-activated strands within the web. In further advantageous aspects, mechanical incremental stretching may be performed in conjunction with an impinging fluid directed onto the surface of the web. Advantageously, the impinging fluid is air or water.

With respect to the multicomponent strands, the first and second components can be derived from any of a wide variety of polymers. In one embodiment of the invention, the first polymer component is formed from an elastomeric polyurethane, elastomeric styrene block copolymer, or an elastomeric polyolefin and the second polymer component is formed from a polyolefin that is less elastic than the first component.

Aspects of the invention are directed to the production of strands having a sheath/core configuration in which the step of incremental stretching forms corrugations within both the sheath and the core of the strands. Individual strands are lengthy, generally extruded continuously and are infinite in length. The strands are not broken into smaller lengths after the activation by incremental stretching; rather, the strands have generally been formed in structures that have a corrugated, bellows-like configuration throughout substantially the entire length of the nonwoven web that has been subjected to the incremental stretching. This corrugated appearance and structure can be observed using standard microscopy techniques, and are difficult if not impossible to detect using the unaided eye. The thicknessof the individual folds in the incrementally stretched and corrugated portions of the nonwoven web are essentially the width of the sheath component of the strand, and as such are typically on the order of 0.1 to 2 microns in thickness. Alternative aspects of the invention involve melt spinning strands having either segmented pie-wedge or tipped multilobal configurations and using incremental stretching to split the components apart from one another or form corrugations, serpentines, or other forms of texture down the length of the strands.

The present invention further includes elastic nonwoven fabrics produced by the methods of the invention, as well as multicomponent elastic fibers. In one advantageous embodiment, multicomponent elastomeric fibers exhibiting an overall helical configuration (similar to the appearance of a candy cane or barber pole) are provided. In beneficial aspects of these embodiments, the helical fibers may further be split to produce helically wrapped fibers of the non-elastomeric components around one or more elastomeric components.

In one broad respect, this invention is a method for producing an elastic nonwoven fabric, comprising: incrementally stretching a nonwoven web in at least one direction to activate the elastic properties of the nonwoven web and to form the elastic nonwoven fabric, wherein the nonwoven web comprises a plurality of multicomponent strands having first and second polymer components longitudinally coextensive along the length of the strands, said first component comprising an elastomeric polymer, and said second polymer component comprising a polymer less elastic than the first polymer component. In one embodiment, the nonwoven web can be formed by: melt spinning a plurality of multicomponent strands having first and second polymer components longitudinally coextensive along the length of the strands, said first component comprising an elastomeric polymer, and said second polymer component comprising a non-elastomeric polymer; forming the multicomponent strands into a nonwoven web; and bonding or intertwining the strands to form a coherent bonded nonwoven web. In one embodiment, the incremental stretching of the web may comprise stretching the fabric so that portions of the multicomponent strands are stretch-activated and become elastic, while other portions of the strands are not stretch-activated and are substantially less elastic. In one embodiment, the incrementally stretching the web may comprises stretching the fabric so that substantially all of the multicomponent strands are stretch-activated and become elastic. In one embodiment, the incrementally stretching the web comprises incrementally stretching the web in both the machine direction and in the cross-machine direction. In one embodiment, the incrementally stretching the web comprises directing the web through at least one pair of interdigitating stretching rollers at a temperature less than 35 degrees Centigrade. In one embodiment, directing the web through interdigitating stretching rollers includes forming narrow, spaced apart longitudinally extending stretch-activated elastic zones in the fabric, separated by intervening longitudinally extending non-activated zones that are substantially less elastic. In one embodiment, the incrementally stretching the web comprises directing the web through a first pair of interdigitating stretching rollers to stretch activate at a first portion of the web and subsequently directing the web through a second pair of interdigitating stretching rollers to stretch activate a second portion of the non-activated strands within the web. In one embodiment, the incrementally stretching the web further comprises impinging fluid onto the surface of the web. In one embodiment, the fluid is either water or air. In one embodiment, the first polymer component comprises an elastomeric polyurethane, and the second polymer component comprises a polyolefin that is less elastic than the elastomeric polyurethane, and in another embodiment the second polymer component is polypropylene, polyethylene, or a blend thereof. In one embodiment, the melt spinning comprises arranging the first and second polymer components in the strand cross-section to form a sheath/core configuration, and wherein the step of incrementally stretching includes forming corrugations in both the sheath and the core of the strands. In one embodiment, the melt spinning comprises arranging the first and second polymer components in the strand cross-section to form the polymer components in a segmented pie configuration, and wherein the step of incrementally stretching includes splitting the first and second polymer components apart from one another. In one embodiment, the melt spinning comprises arranging the first and second polymer components in the strand cross-section to form polymer components in a tipped multilobal configuration, and wherein the step of incrementally stretching includes either splitting the first and second polymer components apart from one another or forming crimps or forming serpentines or other non-linear, random textures down the length of the strand. In one embodiment, at least a portion of the multicomponent strands has a sheath/core configuration. In one embodiment, at least a portion of the multicomponent strands have a trilobal or tipped trilobal configuration. Any combination of these embodiments or other embodiments described herein can be employed in the practice of this invention.

In another broad respect, this invention is an elastic nonwoven fabric comprising: a plurality of multicomponent strands randomly arranged to form a nonwoven web; a multiplicity of bond sites or substantially randomly intertwined strands bonding the strands together to form a coherent bonded nonwoven web; the strands of the web including first and second polymer components, the first polymer component comprising an elastomeric polymer, and the second polymer component comprising a non-elastomeric polymer; and wherein first portions of the multicomponent strands of the web are stretch-activated and elastic. In one embodiment, other portions of the multicomponent strands of the web are not stretch-activated and less elastic than the first portions. In one embodiment, the fabric includes narrow, spaced apart longitudinally extending stretch-activated elastic zones in the fabric, separated by intervening longitudinally extending non-activated, substantially less elastic zones. In one embodiment, the first polymer component comprises an elastomeric polyurethane, and the second polymer component comprises a polyolefin. In one embodiment, the second polymer component is polypropylene, polyethylene, or blend thereof. In one embodiment, the first and second polymer components are arranged in a sheath core configuration, and the stretch-activated portions of the stands have corrugations in the sheath and in the core of the strands. In one embodiment, the first and second polymer components are arranged in a segmented pie configuration, and the stretch-activated portions of the strands have either the first and second polymer components split apart from one another or the components both exhibit crimps down their length. In one embodiment, the first and second polymer components are arranged in a tipped multilobal configuration, and the stretch-activated portions of the strands have either the first and second polymer components split apart from one another or the components both exhibit crimps down their length.

In another broad respect, this invention is a multicomponent fiber comprising an elastomeric component and a component having less elasticity than the elastomeric component, said multicomponent fiber exhibiting an overall helical configuration which includes the components having less elasticity bulked around the elastomeric component. In one embodiment, the fiber has been subjected to incremental stretching.

In another broad respect, this invention is a garment comprising a plurality of layers, wherein at least one of said layers comprises the nonwoven fabric described above. The garment can be, for example, a training pant, a diaper, an absorbent underpant, underwear, an incontinence product, a feminine hygiene item, an industrial apparel, a coverall, a head covering, a pant, a shirt, a glove, a sock, wipes, a surgical gown, wound dressings, bandages, a surgical drape, a face mask, a surgical cap, a surgical hood, a shoe covering, or a boot slipper.

In another broad respect, this invention is an incrementally stretch activated nonwoven web, made from the multicomponent strands.

The fibers and articles of the present invention have utility in a variety of applications. Suitable applications include, for example, but are not limited to, disposable personal hygiene products (e.g. training pants, diapers, absorbent underpants, incontinence products, feminine hygiene items and the like); disposable garments (e.g. industrial apparel, coveralls, head coverings, underpants, pants, shirts, gloves, socks and the like); infection control/clean room products (e.g. surgical gowns and drapes, face masks, head coverings, surgical caps and hood, shoe coverings, boot slippers, wound dressings, bandages, sterilization wraps, wipers, lab coats, coverall, pants, aprons, jackets), and durable and semi-durable applications such as bedding items and sheets, furniture dust covers, apparel interliners, car covers, and sports or general wear apparel.

DETAILED DESCRIPTION OF THE INVENTION

Figure 1A:
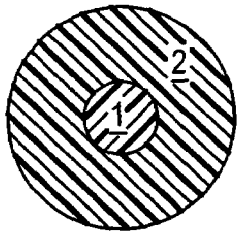
FIGS. 1A–1M illustrate cross sectional views of strands made in accordance with the present invention.

The present invention will be described more fully hereinafter in connection with illustrative embodiments of the invention which are given so that the present disclosure will be thorough and complete and will fully convey the scope of the invention to those skilled in the art. However, it is to be understood that this invention may be embodied in many different forms and should not be construed as being limited to the specific embodiments described and illustrated herein. Although specific terms are used in the following description, these terms are merely for purposes of illustration and are not intended to define or limit the scope of the invention. As an additional note, like numbers refer to like elements throughout.

As discussed above, the present invention generally relates to the production and use of webs produced from multicomponent strands. It should be understood that the scope of the invention is meant to include strands with two or more components. Further, in this invention, "strand" is being used as a term generic to refer to strands, fibers, and filaments. Thus, the terms "strand" or "fiber" or "filament" as used herein are synonymous.

Referring now to FIGS. 1A–1M, cross sectional views of exemplary multicomponent strands of the present invention are provided. As shown, the multicomponent strands generally include a first polymeric component 1 and a second polymeric component 2.

The first polymeric component is formed from one or more "elastomeric" polymers. The term "elastomeric" generally refers to polymers that, when subjected to an elongation, deform or stretch within their elastic limit. For example, spunbonded fabrics formed from elastomeric filaments typically have a root mean square average recoverable elongation of at least about 75% based on machine direction and cross direction recoverable elongation values of the fabric after 30% elongation of the fabric and one pull. Advantageously, spunbonded fabrics formed from elastomeric filaments typically have a root mean square average recoverable elongation of at least about 65% based on machine direction and cross direction recoverable elongation values of the fabric after 50% elongation of the fabric and one pull.

The second component is formed from one or more extensible polymers, e.g. one or more non-elastomeric polymers. The second component polymer may have elastic recovery and may stretch within its elastic limit as the multicomponent strand is stretched. However, the second component is selected to provide poorer elastic recovery, e.g. be less elastic, than the first component polymer. As such, the second component is beneficially a polymer which can be stretched beyond its elastic limit and permanently elongated by the application of tensile stress.

The first and second components are generally present in longitudinally extending "zones" of the strand. The arrangement of the longitudinally extending zones in the strand can be seen from the cross-sectional views set forth in FIGS. 1A–1M. As can be seen in each of these figures, the first polymeric component, 1, and second polymeric component, 2, are present in substantially distinct zones in the strand.

Figure 1B:
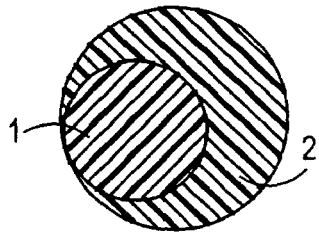
Figure 1C:
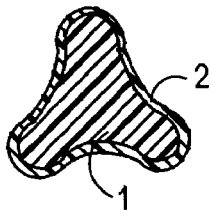
Figure 1D:
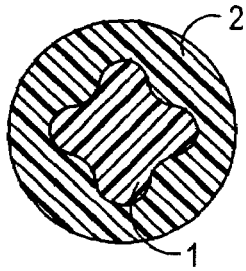
Figure 1E:
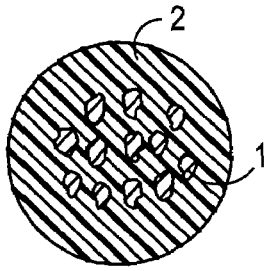
Figure 1F:
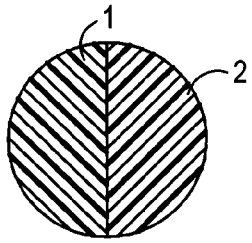
Figure 1G:
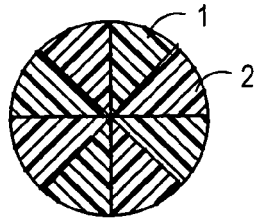
Figure 1H:
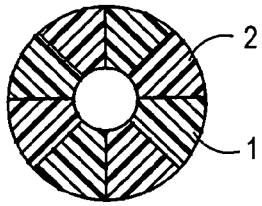

In advantageous embodiments of the invention, the zone of the second component constitutes substantially the entire peripheral surface of the strand, as illustrated by FIGS. 1A through 1E. Beneficially, the second component constitutes at least about 50% of the peripheral surface of the strand. Exemplary configurations of such embodiments include concentric and eccentric sheath/core configurations (FIGS. 1A and 1B, respectively). Further exemplary sheath/core cross sections include trilobal (FIG. 1C) and round with a quadrilobal core (FIG. 1D). Further aspects including a peripheral second component include the "islands in a sea" cross section (FIG. 1E). In the "islands in a sea" configuration, the first component is distributed into a number of fine continuous strands. In advantageous embodiments of the invention, the strands of the invention are configured in either the symmetric sheath/core arrangement of FIG. 1A or the asymmetrical sheath/core arrangement of FIG. 1B. Asymmetrical configurations advantageously induce a helical (coil) shape or other means of bulking the conjugate strands, resulting in increased loft in fabrics produced therefrom.

Alternatively, the strand may be configured so that the first and second components may be split or separated to form finer denier microfilaments. For example, the strand may include first and second components arranged so as to form distinct unocclusive cross-sectional segments extending along the length of the fiber such that the segments are dissociable. As used herein, the terms "split" and "dissociable" include strands exhibiting any amount of separation within any portion of the components within the strands. In advantageous embodiments, at least 50% of the original total interface between the components is no longer joined following splitting.

Figure 1I:
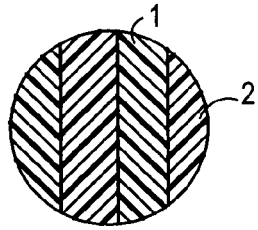

Exemplary strand configurations for the splittable embodiments include side-by-side configurations (FIG. 1F), pie-wedge configurations (FIG. 1G), hollow pie-wedge configurations (FIG. 1H) and sectional configurations (FIG. 1I). In one advantageous embodiment, a splittable strand having a tipped trilobal construction (FIG. 1M) is provided. In such advantageous embodiments, the tips 2 may beneficially be formed from non-elastomeric polymer while the innermost section 1 may be formed from elastomeric polymer.

Figure 1J:
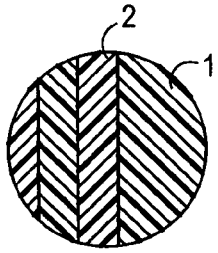
Figure 1K:
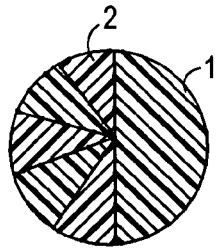

It is to be noted that suitable splittable configurations need not have a symmetrical geometry provided that they are not occlusive or interlocking to such an extent that splitting is precluded. Consequently, suitable splittable configurations also include asymmetrical configurations, such as those shown in FIGS. 1J and 1K. FIG. 1J illustrates a conjugate strand of a sectional configuration that has an unevenly large end segment. FIG. 1K illustrates a conjugate strand having a pie-wedge configuration that has one unevenly large segment. These asymmetrical configurations are suitable for imparting a helical or spiral shape to the conjugate fibers and, thus, for increasing the loft of the fabric produced therefrom.

Figure 1L:
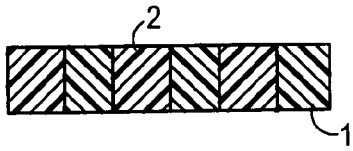
Figure 1M:
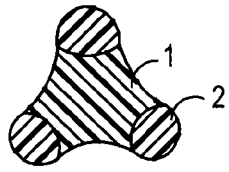

The splittable strands need not be conventional round fibers. Other useful shapes include rectangular, oval and multilobal shapes and the like. Particularly suitable strand shapes for the present invention are rectangular or oval shapes. FIG. 1L illustrates the cross-section of an exemplary rectangular conjugate strand.

Each of the components within the multicomponent strands may further be separated into any number of segments, particularly in splittable configurations. For example, each component within the multicomponent strand may be separated into about 2 to 20 segments. For example, in one advantageous embodiment, a multicomponent strand having 4 segments is provided. The multicomponent strands of the invention may further be produced in a wide range of denier. Exemplary deniers for the multicomponent strands range from about 1.5 to 15. In one advantageous embodiment, the multicomponent strand is about a 2 denier strand.

The first and second components may be present within the multicomponent strands in any suitable amounts, depending on the specific shape of the fiber. In advantageous embodiments, the first component forms the majority of the fiber, i.e., greater than about 50 percent by weight, based on the weight of the strand ("bos"). For example, the first component may beneficially be present in the multicomponent strand in an amount ranging from about 80 to 99 weight percent bos, such as in an amount ranging from about 85 to 95 weight percent bos. In such advantageous embodiments, the non-elastomeric component would be present in an amount less than about 50 weight percent bos, such as in an amount of between about 1 and about 20 weight percent bos. In beneficial aspects of such advantageous embodiments, the second component may be present in an amount ranging from about 5 to 15 weight percent bos, depending on the exact polymer(s) employed as the second component. In one advantageous embodiment, a sheath/core configuration having a core to sheath weight ratio of greater than or equal to about 85:15 is provided, such as a ratio of 95:5. Alternatively, the first component may be present in amounts as low as about 30 weight percent or less, particularly in applications in which fiber economics are the primary concern.

Applicants have found that unexpected properties are provided by multicomponent strands having particular configurations which further contain an effective amount of particular components. More specifically, Applicants have determined that in embodiments in which the zone of the second component constitutes substantially the entire peripheral surface of the strand, such as the embodiments illustrated in FIGS. 1A through 1E, intermittent corrugations may be made to arise within both the first and second components upon sufficient stretch activation if the second component is present in amounts of less than about 20 weight percent bos. The corrugations give the resulting fabrics a microfiber tactility.

The corrugations, present in both the sheath and core, are in the form of a plurality of ribs formed in the circumferential direction perpendicular to the fiber axis which extend along the direction of the fiber axis. These corrugations impart a bellows-like outer surface shape to the fiber periphery. Beneficially, the height of the ribs (peak to valley) is at least about 1/20 of the fiber diameter. Advantageously, the ribs each have widths (peak to peak) of up to several microns. The corrugations, triggered by a stretch activation step, are present within the fibers as they rest in a relaxed state. The shape and dimension of the corrugations can be readily changed. For example, the axial-direction pitch, height and width can be changed by altering the type of polymer, component ratio, the amount of drawing occurring during spinning and/or stretch activation, or the fiber cooling rate.

The splittable strands of the invention may also exhibit advantageous fiber geometries. More specifically, splittable strands of the invention can form self-bulked constructions when the non-elastomeric components within stretch activated strands bulk up, or bunch up, around the more centrally located elastomeric components(s) following splitting. This bulking produces "self-textured" strands that are characterized by a softer touch or feel in comparison to comparable non-bulked strands. Dissociated splittable configurations may further exhibit kinks or crimps down their length upon splitting. Such kinking or crimping would also be expected to contribute to a softer touch or feel within the split fibers.

In advantageous embodiments the elastomeric component is present within the interior region of or otherwise recessed within the splittable configuration to further optimize the resulting softness of the split fiber and to minimize contact between elastomeric components of adjacent strands during spinning and quenching. For example, a tipped trilobal fiber may be provided with an elastomeric interior and non-elastomeric tips. To further diminish the aesthetic impact of the elastomeric polymer and to decrease the amount of interstrand elastomeric contact during extrusion, the amount of the elastomeric component may be minimized within the non-fully encompassing multicomponent configurations. For example, it may be advantageous to include 70 weight percent or less of the elastomeric component within splittable configurations.

As briefly noted above, spiral or helical fibers may further be formed in accordance with the invention. Spiral or helically configured strands can provide numerous benefits to fabric structures, including increased loft. Asymmetrical configuration such as FIGS. 1B, 1J or 1K may be utilized to impart a spiral structure to the multicomponent strand, as noted above. A modified spinneret design may also be used to impart a spiral or helical structure to the strand. More specifically, the exit surface of the spinneret holes (or slots) may be cut at an angle, such as an oblique angle, relative to the normal plane of the spin line. This oblique angle is believed to impart angular momentum into the composite fiber strand, causing it to twist or rotate on axis. This design does not rely on differential polymer properties, draw, nor heat to create the spiral configuration. In the case of undrawn filaments, it is anticipated that the shape of the filament will be like that of a screw, where at least part of the threads of the screw consist of the second, non-elastomeric component and the shaft consists mainly of the elastomer. This is different that what occurs in many drawn or heated multi-constituent fibers where the filaments look more like springs (known as helical crimp). The inventive fibers may form both helical twist (screw) and helical crimp (coil spring) due to processing.

Helical or spiral strands in accordance with the invention are beneficial because they further minimize any potential elastomer-elastomer contact between adjacent fibers. Further, in splittable helical constructions the non-elastomeric component can become better wrapped around the elastomeric component after splitting. This enhanced wrapping in helical splittable configurations improves the shielding properties of the second component, decreasing the rubbery feel of the resulting fabric and imparting a softer touch due to the enhanced bulking. These advantages are present in both the split and non-split fiber cases.

Materials for use as the first and second components can vary widely. Typically the materials are selected based on the desired function for the strand. In one embodiment, the polymers used in the components of the invention have melt flows ranging from about 5 to about 1000. Generally, the meltblowing process will employ polymers of a higher melt flow than the spunbonded process.

The first component may be formed from any combination of one or more elastomeric polymers known in the art. For example, the first component may be formed from polyurethane (including both polyester polyurethane and polyether polyurethane), polyetherester, polyetheramides, low crystalline (<0.90 g/cm$^3$ density) polyolefins (such as elastomeric polypropylene, elastomeric polyethylene, and copolymers and interpolymers based on propylene and/or ethylene), interpolymers (random copolymers of crystallizable and noncrystallizable components such as ethylene/styrene pseudo-random compolymers), elastomeric fiber forming block copolymers, and mixtures thereof. Elastomeric polypropylene is described, for example, in U.S. Pat. No. 6,525,157, WO 2003040201 (U.S. Patent Application 20030088037 corresponds to WO 2003040201), all of which are incorporated by reference. Exemplary elastomeric fiber forming block copolymers include co-polyesters, copolyamides, diblock and triblock copolymers based on polystyrene (S) and unsaturated or fully hydrogenated rubber blocks. The rubber blocks for use in conjunction with polystyrene include butadiene (B), isoprene (I), or the hydrogenated version, ethylene-butylene (EB). Thus, S-B, S-I, S-EB, as well as S-B-S, S-I-S, and S-EB-S block copolymers can be used. In advantageous embodiments, the first component is formed from a polyurethane, such as polyester polyurethane, or a polyester elastomer.

Suitable polyurethanes for inclusion in the first component are not particularly restricted if they have fiber formability, but thermoplastic, low hardness (Shore A≦80) polyurethanes are considered beneficial. A thermoplastic polyurethane is a polymer which is obtained by reacting a high molecular weight diol, an organic diisocyanate, and a chain extender and can be melt spun. Advantageously, the molecular weight of the polyurethane elastomer is at least 100,000 Daltons.

The high molecular weight diol has hydroxyl groups at both ends and may have an average molecular weight of 500–5,000. Examples of high molecular weight diols are the either type polyols, e.g., polytetramethylene glycol, polypropylene glycol, etc., the ester type polyols, e.g., polyhexamethylene adipate, polybutylene adipate, polycarbonate diol, polycaprolactone diol, etc. or mixtures thereof.

As the chain extender, there is 1,4-butanediol, ethylene glycol, propylene glycol, bis(2-hydroxyethoxy)benzene having a molecular weight of 500 or less. Of these, 1,4 butanediol and bishydroxyethoxybenzene are common and may advantageously be employed. Chain extenders with 1 or more amine terminations, for example ethanol amine or ethylene diamine, may be considered, but normally used as mixtures with diol chain extenders and at relatively low percentages (<10% by weight of the chain extender).

Exemplary organic diisocyanates include tolylene diisocyanate (TDI), 4,4'-diphenylmethane diisocyanate (MDI), non-yellowing diisocyanates such as 1,6-hexanediisocyanate, etc., and mixtures thereof. Of those, MDI is particularly advantageous.

The weight percent hard segment (% HS), which is an index of the MDI and chain extender content in polyurethanes and relates to the hardness of polyurethanes, generally ranges from about 55 weight percent to 15 weight percent. In advantageous embodiments, polyurethane includes from about 40 weight percent to 20 weight percent hard segments.

Further, known modifiers or miscibilizing agents, such as titanium dioxide, dyes and pigments, UV stabilizer, UV absorbent, bactericide, etc. can be added to the polyurethane.

In addition to the above mentioned high molecular weight diols, organic isocyanates, and chain extenders, small percentages of comparable components having higher functionality, i.e. having more than 2 hydroxyl or isocyanate groups, may be blended into the polyurethane to impart some cross-linking. Generally it is beneficial to keep the total cross-linking below 10 equivalence %, such as below 5 equivalence %.

As noted above, polyester elastomers may also be employed as the elastomeric component. Generally, polyester elastomers include a short chain ester section as the hard segment and a long chain polyether section and/or a long chain polyester section as the soft segment. The short chain ester typically consists of an aromatic dicarboxylic acid and a low-molecular weight diol having a molecular weight of 250 or less. Suitable aromatic dicarboxylic acids for the hard segment include terephthalic acid, isophthalic acid, bibenzoic acid, substituted dicarboxylic compounds having two benzene nuclei, e.g., bis(p-carboxyphenyl)methane, p-oxy (p-carboxyphenyl) benzoic acid, ethylene-bis(p-oxybenzoic acid), 1,5-naphthalenedicarboxylic acid, and the like. Phenylenedicarboxylic acids, namely terephthalic acid and isophthalic acid, are especially beneficial. Exemplary low-molecular weight diols include any diol having a molecular weight of about 250 or less, such as ethylene glycol, propylene glycol, tetramethylene glycol, hexamethylene glycol, cyclohexane dimethanol, resorcinol, hydroquinone, and the like. Advantageously, the aliphatic diols contain 2–3 carbon atoms.

Exemplary long chain polyether sections for use in the polyester elastomers include poly(1,2-and 1,3-propylene oxide) glycol, poly(tetramethylene oxide) glycol, ethylene oxide-1, 2-propylene oxide random or block copolymer, and the like. Poly(tetramethylene oxide) glycol can be advantageously employed as the long chain polyether. Exemplary long chain polyester sections for use in the polyester elastomers include poly(aliphatic lactone diol), such as polycaprolactone diol, polyvalerolactone diol, and the like. Polycaprolactone diol is particularly advantageous. As the other long chain polyester part, there are aliphatic polyester diols such as reaction products of dibasic acids, e.g., adipic acid, sebacic acid, 1,3-cyclohexane dicarboxylic acid, glutaric acid, succinic acid, oxalic acid, azelaic acid, and the like, with low-molecular weight diols, e.g., 1,4-butanediol, ethylene glycol, propylene glycol, hexamethylene glycol and the like. Polybutylene adipate is particularly advantageous as a long chain polyester.

As examples in the above-exemplified elastomers, articles on the markets such as HYTREL® elastomers (Du Pont-Toray Co.), PELPRENE® elastomers (Toyobo Co.), GRILUX® elastomers (Dainippon Ink and Chemicals Inc.), ARNITEL® elastomers (AKZO Co.) can be used.

Polyamide elastomers also comprise a hard segment and a soft segment. As the hard segment, a polyamide block such as nylon 66, 610, 612, or nylon 6, 11, 12 may be used while as the soft segment, a polyether block such as polyethylene glycol, polypropylene glycol, polytetramethylene glycol and the like or an aliphatic polyester diol may be used. The properties of the resulting polyamide elastomer varies with the polyamide raw material for the hard segment, polyether or polyester raw material for the soft segment, and the hard segment/soft segment ratio. For instance, when the hard segment is increased, the mechanical strength, heat resistance, and chemical resistance are improved, but the rubber elasticity is lowered. Conversely, when the hard segment is decreased, the cold resistance, and softness are improved.

As examples for the above-exemplified polyamide elastomers, articles on the market such as DIAMIDE® elastomers (Daicel Huls Co.), PEBAX® elastomers (Toray Corp.) and GRILUX® elastomers (Dainippon Ink and Chemicals Inc.) can be used.

Polystyrene based block copolymer elastomers similarly comprise a hard segment and a soft segment. The hard segment can be formed from polystyrene. The soft segment can be derived from polybutadiene, polyisoprene, or polyethylene butylene that has been block copolymerized. Elastomers obtained from the above ingredients can be expressed by SBS, SIS, and SEBS. Random copolymers of styrene and, for example, ethylene, typified by polyethylene runs with occasional insertions of a single styrene molecule, may also be used. Further, if the styrene section is increased the mechanical strength increases, but it tends to raise the hardness and lose the rubber elasticity. Conversely, if the styrene section is decreased, the opposite occurs.

As the above-exemplified polystyrene elastomers, articles on the market such as KRATON G® elastomers (Kraton Corp.), VECTOR elastomers (Dexco), CARIFLEX® elastomers (Shell Kagaku K.K.), RABALON® elastomers (Mitsubishi Petroleum Co.), TUFPRENE® elastomers (Asahi Chemical Industry Co.), ARON® elastomers (Aron Co.) can be used.

Further commercially available elastomers for use in the present invention include PELLETHANE™ polyurethane by Dow Chemical, the KRATON polymers sold by Kraton Corp., and the VECTOR polymers sold by DEXCO. Other elastomeric thermoplastic polymers include polyurethane elastomeric materials such as ELASTOLLAN sold by BASF, ESTANE sold by B.F. Goodrich Company, polyester elastomeric materials such as ARNITEL sold by Akzo Plastics; and polyetheramide materials such as PEBAX sold by Elf Atochem Company. Heterophasic block copolymers, such as those sold by Montel under the trade name CATALLOY are also advantageously employed in the invention. Also suitable for the invention are polypropylene polymers and copolymers described in U.S. Pat. No. 5,594,080. Elastomeric polyethylene, such as 58200.02 PE elastomer, available from Dow Chemical, and EXACT 4023, available from the Exxon Chemical Company, may also be used as the first component. Polymer blends of elastomers, such as those listed above, with one another and with non-elastomeric thermoplastic polymers, such as polyethylene, polypropylene, polyester, nylon, and the like, may also be used in the invention. Those skilled in the art will recognize the elastomer properties can be adjusted by polymer chemistry and/or blending elastomers with non-elastomeric polymers to provide elastic properties ranging from full elastic stretch and recovery properties to relatively low stretch and recovery properties.

Where the first component is to be a blend of one of more elastomers, the materials are first combined in appropriate amounts and blended. Among the commercially well suited mixers that can be used include the Barmag 3DD three-dimensional dynamic mixer supplied by Barmag AG of Germany and the RAPRA CTM cavity-transfer mixer supplied by the Rubber and Plastic Research Association of Great Britain.

The second component may be formed from any polymer or polymer composition exhibiting inferior elastic properties (less elasticity) in comparison to the polymer or polymer composition used to form the first component. Exemplary non-elastomeric, fiber-forming thermoplastic polymers include polyolefins, e.g. polyethylene, polypropylene, and polybutene, polyester, polyamide, polystyrene, and blends thereof. It should be appreciated that these polymers may be homopolymers or may include relatively small amount of comonomers.

One specific example of a suitable second component polymer composition is a polyethylene/polypropylene blend. Typically in this blend, polyethylene and polypropylene are blended in proportions such that the material comprises between 2 and 98 percent by weight polypropylene, with the balance being polyethylene. Strands made from these polymer blends have a soft hand with a very little "stickiness" or surface friction.

Various types of polyethylene may be employed in the second component with the most preferred being linear, low density polyethylenes. LLDPE can be produced such that various density and melt index properties are obtained which make the polymer well suited for melt-spinning with polypropylene. Linear low density polyethylene (LLDPE) also performs well in filament extrusion. Preferred density values range from 0.87 to 0.96 g/cc with 0.90 to 0.96 being more preferred, and preferred melt index values usually range from 0.2 to about 150 g/10 min. (ASTM D1238-89, 190° C.).

The propylene included within the second component can be an isotactic or syndiotactic polypropylene homopolymer, copolymer, or terpolymer with the most preferred being in the form of a homopolymer. Modified, low-viscosity or high melt flow (MF) polypropylene (PP) may be employed. Exemplary melt flows include 35, 25, and 17. Examples of commercially available polypropylene polymers which can be used in the present invention include ARCO 40-7956X, BP 50-7657X, Basell PH805, and Exxonmobil 3155E2.

Exemplary polyesters suitable for use in the second component include copolymerized polyesters which are obtained by copolymerizing polyethylene terephthalate as the principal ingredient with up to 50 mole % of another dicarboxylic acid component, such as isophthalic acid and/or up to 35 mole % of another diol component, such as diethyelene glycol, triethylene glycol, neopentyl glycol, butanediol, and the like.

As was the case with the first component, where the second component is a blend, the polymer materials, e.g., polyethylene and polypropylene, are combined in appropriate proportional amounts and intimately blended before producing the fibers.

While the principal components of the multi-component strands of the present invention have been described above, the first and/or second polymeric components can also include other materials which do not adversely affect the multi-component strands. For example, the first and second polymeric components can also include, without limitation, dyes, pigments, antioxidants, UV stabilizers and absorbents, surfactants, waxes, flow promoters, matting agents, conducting agents, bactericides, miscibilizing agents, solid solvents, particulates and material added to enhance the processability or splittability of the components of the composition, radical scavengers, amines, U.V. inhibitors, colorants, fillers, antiblock agents, slip agents, luster modifiers, and the like, and combinations thereof. Typically, if present, each additive is used in an amount less than about 5 percent by weight.

The strands according to the present invention can be used in the formation of fabrics, and, in particular, nonwoven fabrics. The strands may also be used to form yarn and threads which may subsequently be incorporated into knit or woven fabrics.

Multicomponent elastomeric strands in accordance with the invention can be melt spun by any means known in the art of composite fibers. Subsequent to spinning, the multicomponent strands of the invention generally require an activation step, such as a stretch activation step, to develop their full range of elastic properties. For example, the as spun sheath/core strands of the invention are characterized by a relatively smooth surface and stiff feel until an activation process introduces corrugation and improved elasticity into the fiber. The corrugations give rise to suppleness within the strand, as well as a soft hand. The improved elastic behavior imparted by the activation step is indicated by a reduced initial modulus.

Similarly, the as spun splittable strands of the invention are characterized by a relatively smooth surface and stiff feel until an activation process fully or partially splits the strands into their component parts. Following activation by incremental stretching, the resulting split strand exhibits a softer, self-textured surface, with the non-elastomeric components bulking or bunching up around the elastomeric component(s). A reduced initial modulus is similarly noted within activated splittable strands of the invention.

The activation process using incremental stretching is generally performed after the strands have been formed into a nonwoven web or fabric, although it may be done before. The activation process generally incrementally stretches the nonwoven web or fabric about 1.1 to 10.0 fold. In advantageous embodiments, the web or fabric is stretched or drawn to about 2.5 times its initial length. Incremental stretching in accordance with the present invention may be accomplished by any means known in the art.

A number of different stretchers and techniques may be employed to stretch the starting or original laminate of a nonwoven fibrous web and elastomeric film. Incremental stretching can be accomplished using, for example, a diagonal intermeshing stretcher, cross direction ("CD") intermeshing stretching equipment, machine direction ("MD") intermeshing stretching equipment. The diagonal intermeshing stretcher includes a pair of left hand and right hand helical gear-like elements on parallel shafts. The shafts are disposed between two machine side plates, the lower shaft being located in fixed bearings and the upper shaft being located in bearings in vertically slidable members. The slidable members are adjustable in the vertical direction by wedge shaped elements operable by adjusting screws. Screwing the wedges out or in will move the vertically slidable member respectively down or up to further engage or disengage the gear-like teeth of the upper intermeshing roll with the lower intermeshing roll. Micrometers mounted to the side frames are operable to indicate the depth of engagement of the teeth of the intermeshing roll. Air cylinders are employed to hold the slidable members in their lower engaged position firmly against the adjusting wedges to oppose the upward force exerted by the material being stretched. These cylinders may also be retracted to disengage the upper and lower intermeshing rolls from each other for purposes of threading material through the intermeshing equipment or in conjunction with a safety circuit which would open all the machine nip points when activated. A drive means is typically utilized to drive the stationery intermeshing roll. If the upper intermeshing roll is to be disengageable for purposes of machine threading or safety, it is preferable to use an antibacklash gearing arrangement between the upper and lower intermeshing rolls to assure that upon reengagement the teeth of one intermeshing roll always fall between the teeth of the other intermeshing roll and potentially damaging physical contact between addendums of intermeshing teeth is avoided. If the intermeshing rolls are to remain in constant engagement, the upper intermeshing roll typically need not be driven. Drive may be accomplished by the driven intermeshing roll through the material being stretched. The intermeshing rolls can resemble fine pitch helical gears. In one embodiment, the rolls have 5.935" diameter, 45° helix angle, a 0.100" normal pitch, 30 diametral pitch, 141/2° pressure angle, and are basically a long addendum topped gear. This produces a narrow, deep tooth profile which allows up to about 0.090" of intermeshing engagement and about 0.005" clearance on the sides of the tooth for material thickness. The teeth are not designed to transmit rotational torque and do not contact metal-to-metal in normal intermeshing stretching operation. The CD intermeshing stretching equipment is identical to the diagonal intermeshing stretcher with differences in the design of the intermeshing rolls and other minor areas noted below. Since the CD intermeshing elements are capable of large engagement depths, it is important that the equipment incorporate a means of causing the shafts of the two intermeshing rolls to remain parallel when the top shaft is raising or lowering. This is necessary to assure that the teeth of one intermeshing roll always fall between the teeth of the other intermeshing roll and potentially damaging physical contact between intermeshing teeth is avoided. This parallel motion is assured by a rack and gear arrangement wherein a stationary gear rack is attached to each side frame in juxtaposition to the vertically slidable members. A shaft traverses the side frames and operates in a bearing in each of the vertically slidable members. A gear resides on each end of this shaft and operates in engagement with the racks to produce the desired parallel motion. The drive for the CD intermeshing stretcher must operate both upper and lower intermeshing rolls except in the case of intermeshing stretching of materials with a relatively high coefficient of friction. The drive need not be antibacklash. The CD intermeshing elements are machined from solid material but can best be described as an alternating stack of two different diameter disks. In one embodiment, the intermeshing disks would be 6" in diameter, 0.031" thick, and have a full radius on their edge. The spacer disks separating the intermeshing disks would be 5½" in diameter and 0.069" in thickness. Two rolls of this configuration would be able to be intermeshed up to 0.231" leaving 0.019" clearance for material on all sides. As with the diagonal intermeshing stretcher, this CD intermeshing element configuration would have a 0.100" pitch. The MD intermeshing stretching equipment can be identical to the diagonal intermeshing stretch except for the design of the intermeshing rolls. The MD intermeshing rolls closely resemble fine pitch spur gears. In one embodiment, the rolls have a 5.933" diameter, 0.100" pitch, 30 Diametral pitch, 141/2° pressure angle, and are basically a long addendum, topped gear. A second pass can be taken on these rolls with the gear hob offset 0.010" to provide a narrowed tooth with more clearance. With about 0.090" of engagement, this configuration will have about 0.010" clearance on the sides for material thickness. The above described diagonal, CD or MD intermeshing stretchers may be employed to produce the incrementally stretched nonwoven webs of this invention.

Figure 2:
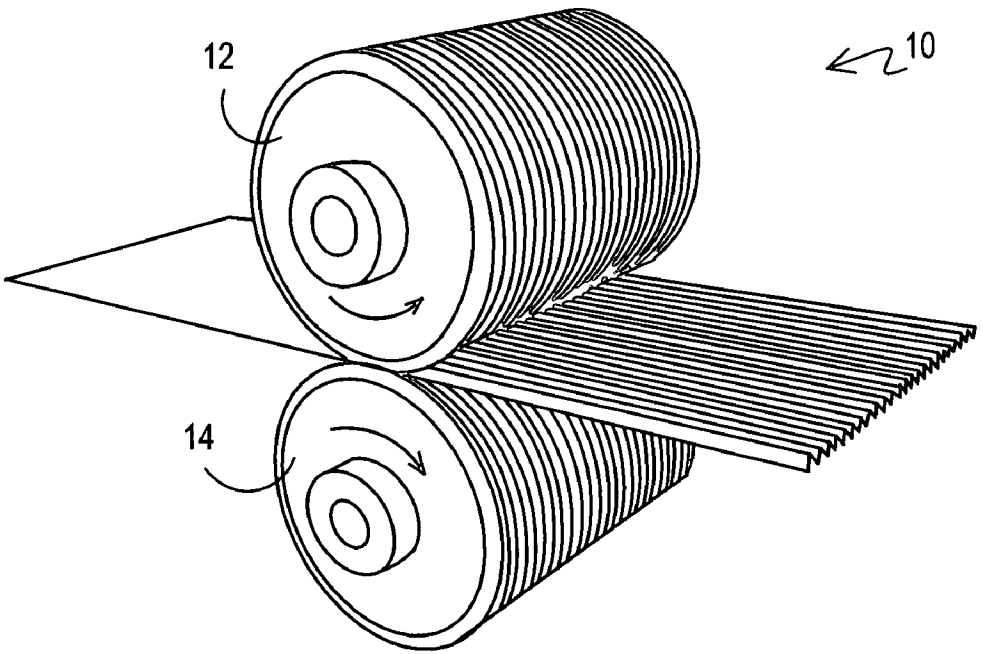
FIG. 2 illustrates a cross direction incremental stretching system in accordance with one aspect of the present invention.

An exemplary configuration of one suitable incremental stretching system is shown in FIG. 2. The incremental stretching system 10 generally includes a pair of first 12 (e.g. top) and second 14 (e.g. bottom) stretching rollers positioned so as to form a nip. The first incremental stretching roller 12 generally includes a plurality of protrusions, such as raised rings, and corresponding grooves, both of which extend about the entire circumference of the first incremental stretching roller 12. The second incremental stretching roller 14 similarly includes a plurality of protrusions, such as raised rings, and corresponding grooves which also both extend about the entire circumference of the second incremental stretching roller 14. The protrusions on the first incremental stretching roller 12 intermesh with or engage the grooves on the second incremental stretching roller 14, while the protrusions on the second incremental stretching roller 14 intermesh with or engage the grooves on the first incremental stretching roller 12. As the web passes through the incremental stretching system 10 it is subjected to incremental drawing or stretching in the cross machine ("CD") direction. In advantageous embodiments the protrusions are formed by rings, and the incremental stretching system is referred to as a "ring roller."

Figure 3:
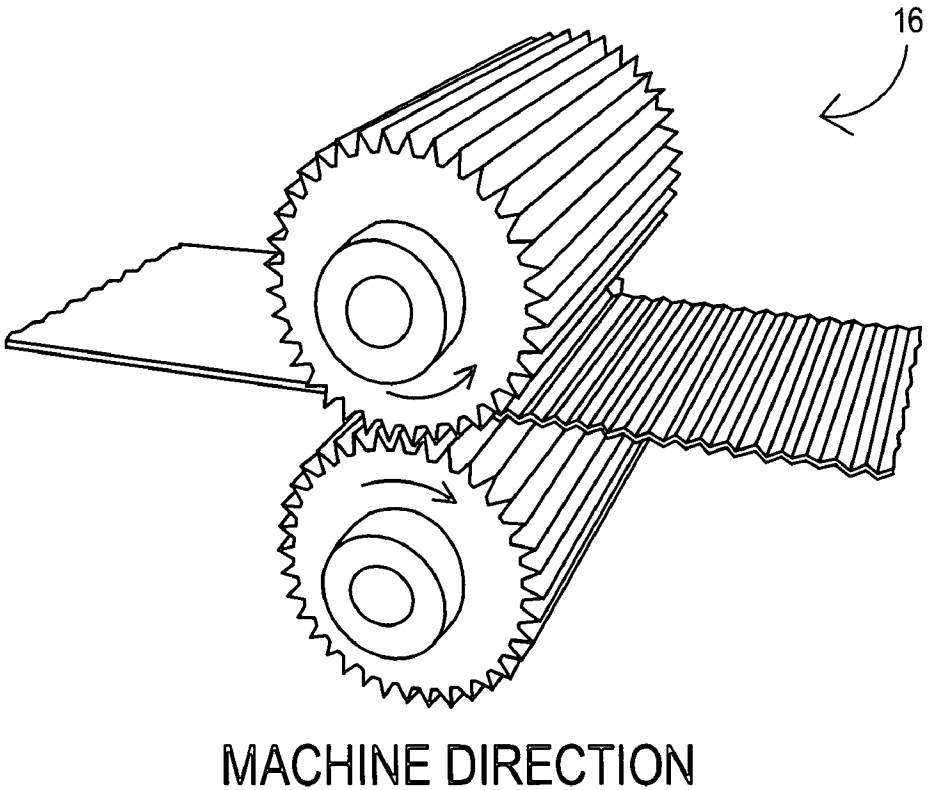
FIG. 3 illustrates a machine direction incremental stretching system in accordance with another aspect of the present invention.

Alternatively or additionally, the web may be incrementally drawn or stretched in the machine direction ("MD") using one or more incremental stretching systems, such as provided in FIG. 3. As shown in FIG. 3, MD incremental stretching systems 16 similarly include a pair of incremental stretching rollers with intermeshing protrusions and grooves. However, the protrusions and grooves within MD incremental stretching systems generally extend across the width of the roller, rather than around its circumference.

Alternatively, incremental stretching may be performed in conjunction with an impinging fluid. For example, heated fluid may be directed onto the surface of the web. Exemplary fluids include water or air. Suitable temperatures for the heated fluid include temperatures less than 35° C.

Due to the nature of incremental stretching processes, only a portion of the web is subjected to stretch activation within a single pass. Stated differently, following a single pass through an incremental stretching system portions of the web (and hence the multicomponent strands) will be stretch activated and more elastic, while other portions of the web (and hence the multicomponent strands) will not be stretch-activated and are substantially less elastic. Therefore, fabrics which are partially activated, e.g. webs that have been subjected to a single pass of incremental stretching, include narrow, spaced apart longitudinally extending stretch-activated elastic zones separated by intervening longitudinally extending non-activated, substantially less elastic zones.

Consequently, webs formed in accordance with the invention may be passed through one or more activation steps to fully develop the elastic properties of the web. For example, webs formed in accordance with the invention may be directed through a series of incremental stretching systems. In beneficial aspects of the invention, webs formed in accordance with the invention are passed through a series of incremental stretching systems that are off-set so that the protrusions of the top roller of the first incremental stretching system are aligned with the grooves of the top roller of a second incremental stretching system. The off-set incremental stretching systems in such embodiments are arranged so as to stretch activate substantially all of the multicomponent within the web. The increasing amount of stretch activated strands within the web following each incremental stretching may be reflected in a number of elastic properties, including a lowering of the webs initial modulus.

Nonwoven webs can be produced from the multicomponent strands of the invention by any technique known in the art. A class of processes, known as spunbonding is one common method for forming nonwoven webs. Examples of the various types of spunbonded processes are described in U.S. Pat. No. 3,338,992 to Kinney, U.S. Pat. No. 3,692,613 to Dorschner, U.S. Pat. No. 3,802,817 to Matsuki, U.S. Pat. No. 4,405,297 to Appel, U.S. Pat. No. 4,812,112 to Balk, and U.S. Pat. No. 5,665,300 to Brignola et al. In general, traditional spunbonded processes include:

a) extruding the strands from a spinneret;

b) quenching the strands with a flow of air which is generally cooled in order to hasten the solidification of the molten strands;

c) attenuating the filaments by advancing them through the quench zone with a draw tension that can be applied by either pneumatically entraining the filaments in an air stream or by wrapping them around mechanical draw rolls of the type commonly used in the textile fibers industry;

d) collecting the drawn strands into a web on a foraminous surface; and e) bonding the web of loose strands into a fabric.

This bonding can use any thermal, chemical or mechanical bonding treatment known in the art to impart coherent web structures. Thermal point bonding may advantageously be employed. Various thermal point bonding techniques are known, with the most preferred utilizing calender rolls with a point bonding pattern. Any pattern known in the art may be used with typical embodiments employing continuous or discontinuous patterns. Preferably, the bonds cover between 6 and 30 percent, and most preferably, 12 percent of the layer is covered. By bonding the web in accordance with these percentage ranges, the filaments are allowed to elongate throughout the full extent of stretching while the strength and integrity of the fabric can be maintained. In alternative aspects of the invention, bonding processes that entangle or intertwine the strands within the web may be employed. An exemplary bonding process which relies upon entanglement or intertwining is hydroentanglement.

All of the spunbonded processes of this type can be used to make the elastic fabric of this invention if they are outfitted with a spinneret and extrusion system capable of producing multicomponent strands. However, one preferred method involves providing a drawing tension from a vacuum located under the forming surface. This method provides for a continually increasing strand velocity to the forming surface, and so provides little opportunity for the elastic strands to snap back.

Another class of process, known as meltblowing, can also be used to produce the nonwoven fabrics of this invention. This approach to web formation is described in NRL Report 4364 "Manufacture of Superfine Organic Fibers" by V. A. Wendt, E. L. Boone, and C. D. Fluharty and in U.S. Pat. No. 3,849,241 to Buntin et al. Conventional meltblowing process generally involve:

a.) Extruding the strands from a spinneret.

b.) Simultaneously quenching and attenuating the polymer stream immediately below the spinneret using streams of high velocity heated air. Generally, the strands are drawn to very small diameters by this means. However, by reducing the air volume and velocity, it is possible to produce strand with deniers similar to common textile fibers.

c.) Collecting the drawn strands into a web on a foraminous surface.

Meltblown webs can be bonded by a variety of means, but often the entanglement of the filaments in the web or the autogeneous bonding in the case of elastomers provides sufficient tensile strength so that it can be wound onto a roll.

Any meltblowing process which provides for the extrusion of multicomponent strands such as that set forth in U.S. Pat. No. 5,290,626 can be used to practice this invention.

Figure 4:
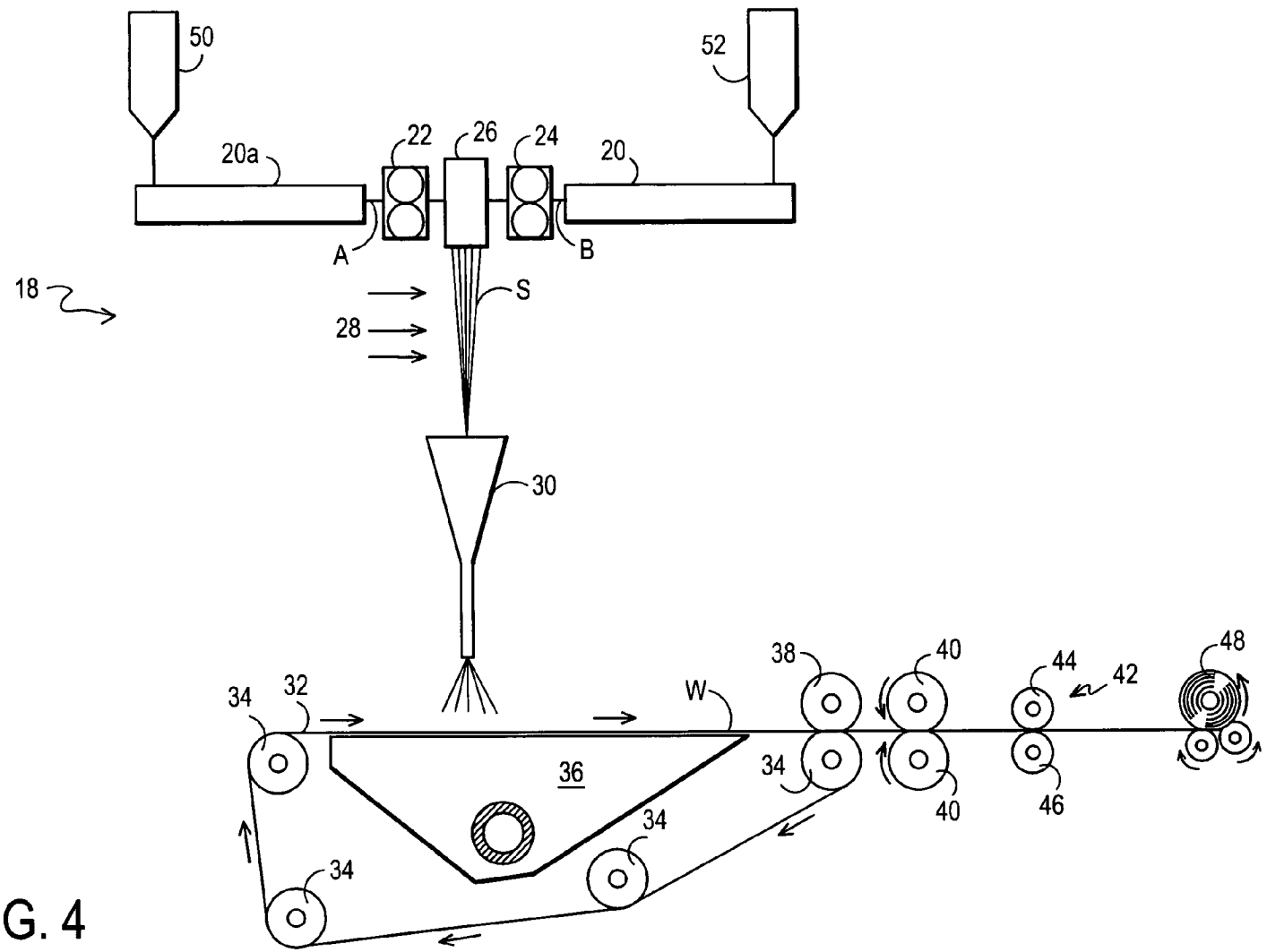
FIG. 4 illustrates one example of a processing line for producing nonwoven fabrics according to the present invention.

For the sake of completeness, one example of a suitable processing line for producing nonwovens from multi-component strands is illustrated by FIG. 4. In this figure, a process line is arranged to produce bi-component continuous strands, but it should be understood that the present invention comprehends nonwoven fabrics made with multi-component filaments having more than two components. For example, the fabric of the present invention can be made with filaments having three or four components. Alternatively, nonwoven fabrics including single component strands, in addition to the multi-component strands can be provided. In such an embodiment, single component and multi-component strands may be combined to form a single, integral web.

The process line 18 includes a pair of extruders 20 and 20*a* for separately extruding the first and second components. The first and second polymeric materials A, B, respectively, are fed from the extruders 20 and 20*a* through respective melt pumps 22 and 24 to spinneret 26. Spinnerets for extruding bi-component filaments are well known to those of ordinary skill in the art and thus are not described here in detail. A spinneret design especially suitable for practicing this invention is described in U.S. Pat. No. 5,162,074. The spinneret 26 generally includes a housing containing a spin pack which includes a plurality of plates stacked on top of the other with a pattern of openings arranged to create flow paths for directing polymeric materials A and B separately through the spinneret. The spinneret 26 has openings arranged in one or more rows. The spinneret openings form a downwardly extending curtain of strands S when the polymers are extruded through the spinneret. For example, the spinneret 26 may be arranged to form tipped trilobal multicomponent filaments. Alternatively, the spinneret 26 may be arranged to form concentric sheath/core bi-component filaments.

The process line 18 also includes a quench air blower 28 positioned adjacent the curtain of filaments extending from the spinneret 26. Air from the quench air blower 28 quenches the filaments extending from the spinneret 26. The quench air can be directed from one side of the filament curtain as shown in FIG. 4, or both sides of the filament curtain.

A fiber draw unit or aspirator 30 is positioned below the spinneret 26 and receives the quenched filaments. Fiber draw units or aspirators for use in melt spinning polymers are well known. Suitable fiber draw units for use in the process of the present invention include a slot attenuator, linear fiber aspirator and eductive guns. In advantageous embodiments a low draw slot is used to attenuate the fibers of the invention.

Generally described, the fiber draw unit 30 includes an elongated vertical passage through which the filaments are drawn by aspirating air entering from the sides of the passage and flowing downwardly through the passage. The aspirating air draws the filaments and ambient air through the fiber draw unit.

An endless foraminous forming surface 32 is positioned below the fiber draw unit 30 and receives the continuous strands S from the outlet opening of the fiber draw unit 30 to form a web W. The forming surface 32 travels around guide rollers 34. A vacuum 36 positioned below the forming surface 32 where the filaments are deposited draws the filaments against the forming surface 32.

The process line 18 further includes a compression roller 38 which, along with the forward most of the guide rollers 34, receive the web W as the web is drawn off of the forming surface 32. In addition, the process line includes a pair of thermal point bonding calender rolls 40 for bonding the bi-component filaments together and integrating the web to form a finished fabric.

In the beneficial embodiment illustrated in FIG. 4, the bonded web on the traveling forming surface 32 is subsequently transported through a stretch activation process in the form of an incremental stretching system 42 that includes a pair of interdigitating stretching rollers 44, 46 that draw the web in either the CD or MD.

Although a single incremental stretching system is illustrated in FIG. 4, in beneficial embodiments a series of such incremental stretching systems may be used to draw the web. For example, two incremental stretching systems may be used to stretch activate the fabric in the CD. Advantageously, the stretching rollers within the two systems may be offset to impart a higher degree of stretch activation to the web. Either alternatively or additionally, one or more incremental stretching systems may be used to stretch activate the web in the MD. In alternative embodiments, the web may be initially stretch activated and then bonded.

Lastly, the process line 18 includes a winding roll 48 for taking up the bonded fabric.

To operate the process line, the hoppers 50 and 52 are filled with the respective first and second polymer components which are melted and extruded by the respective extruders 20 and 20*a* through melt pumps 22 and 24 and the spinneret 26. Although the temperatures of the molten polymers vary depending on the polymers used, when, for example, PELLETHANE™ 2103-70A polyurethane and ARCO 40-7956X polypropylene are used as the first and second components, the preferred temperatures of the polymers at the spinneret range from about 200 to 225° C.

As the extruded strands extend below the spinneret 26, a stream of air from the quench blower 28 at least partially quenches the strands. After quenching, the strands are drawn into the vertical passage of the draw unit 30 by a flow of air through the draw unit 30. It should be understood that the temperatures of the aspirating air in unit 30 will depend on factors such as the type of polymers in the strands and the denier of the strands and would be known by those skilled in the art.

The drawn filaments are deposited through the outer opening of the fiber draw unit 30 onto the traveling forming surface 32. The vacuum 36 draws the strands against the forming surface 32 to form an unbonded, nonwoven web of continuous strands. The web is then lightly compressed by the compression roller 38 and thermal point bonded by bonding rollers 40. Thermal point bonding techniques are well known to those skilled in the art and are not discussed here in detail.

However, it is noted that the type of bond pattern may vary based on the degree of fabric strength desired. The bonding temperature also may vary depending on factors such as the polymers in the filaments.

Although the method of bonding shown in FIG. 4 is thermal point bonding, it should be understood that the fabric of the present invention may be bonded by other means such as oven bonding, ultrasonic bonding, hydroentangling or combinations thereof to make cloth-like fabric. Such bonding techniques such as through air bonding, are well known to those of ordinary skill in the art and are not discussed here in detail.

The bonded web is subsequently subjected to incremental stretching. Although the method of incremental stretching shown in FIG. 4 is a roller based system, any incremental stretching system known in the art may be used. The incremental stretching process is generally performed at elevated temperatures, depending on the polymers employed within the multicomponent strands. In advantageous embodiments, the incremental stretching is performed at a temperature less than 35° C. The incremental stretching process is further generally operated at a depth of roller engagement ranging from about 0.025 to 0.250 inches.

Lastly, the stretch activated web is wound onto the winding roller 48 and is ready for further treatment or use.

The invention is capable of solving the stickiness and blocking problem associated with previous processes while at the same time providing improved properties. The web can be employed in non-limiting exemplary products such as disposable diaper coverstock, adult incontinence bodies, sanitary napkin supports, waistbands, cuffs, side panels for training pants, bandages, durables such as apparel interliners, components for disposable or semi-durable items, such as medical gowns and the like. To this end, the fabric may be treated with conventional surface treatments by methods recognized in the art. For example, conventional polymer additives can be used to enhance the wettability of the fabric. Such surface treatment enhances the wettability of the fabric and thus, facilitates its use as a liner or surge management material for feminine care, infant care, child care, and adult incontinence products.

The fabric of the invention may also be treated with other treatments such as antistatic agents, alcohol repellents and the like, by techniques that would be recognized by those skilled in the art.

The present invention will be further illustrated by the following non-limiting examples. The foregoing examples are illustrative of the present invention and are not to be construed as limiting the scope of the invention or claims appended hereto.

EXAMPLE 1

A web of 10/90 sheath/core bicomponent filaments was prepared on a spunbond apparatus similar to that described in FIG. 4. The core was prepared from PELLETHANE2103-70A polyurethane and the sheath was prepared from Dow ASPUN 6811A polyethylene. The filaments were spun through a die having 144 holes of 0.35 mm diameter. The filaments were drawn at a speed of approximately 600 m/min through an air attenuation device and distributed on a foraminous belt as a web of 68 gsm basis weight. The denier of the filaments was approximately 5. The web was thermally point bonded at a temperature of 111° C. and passed through mechanical incremental stretching devices so that it was stretched in both the machine direction and the cross machine direction. The mechanical properties of the fabric are given in Table 1.

EXAMPLE 2

A web of 9/91 sheath/core bicomponent filaments was prepared in the apparatus used for Example 1. The core was prepared from PELLETHANE2102-75A polyurethane and the sheath was prepared from Arco 40-7956x polypropylene. The web was thermal point bonded at 136° C. and mechanically incrementally stretched in both the machine direction and the cross machine direction. The mechanical properties of this fabric are given in Table 1.

EXAMPLE 3

A web of 10/90 sheath/core bicomponent filaments was prepared on an apparatus similar to that described in FIG. 4. The core was prepared from PELLETHANE2102-75A polyurethane and the sheath was prepared from Arco 40-7956X polypropylene. The filaments were spun through a die having 4000 holes of 0.35 mm diameter across a width of 1.2 meters. The filaments were drawn at a speed of approximately 1200 m/min through an air attenuation device and distributed on a foraminous belt to form a web of 50 gsm basis weight. The denier of the filaments was approximately 5. The web was thermal point bonded at a temperature of 138° C. and mechanically incrementally stretched in both the machine and cross machine direction. The mechanical properties of this fabric are given in Table 1.

EXAMPLE 4

A web of 20/80 sheath core bicomponent filaments was prepared on an apparatus similar to that described in FIG. 4. The core was prepared from PELLETHANE2102-75A polyurethane and the sheath was prepared from Dow ASPUN 6811A polyethylene. The web was thermal point bonded at 118° C. and mechanically incrementally stretched in both the machine direction and the cross machine direction. The mechanical properties of this fabric are given in Table 1.

TABLE 1

PROPERTIES OF ELASTIC BICOMPONENT FABRICS

| Example | 1 | 2 | 3 | 4 |
|---|---|---|---|---|
| Basis Weight Grams per square meter | 68 | 62 | 50 | 50 |
| MD Tensile g/in | 867 | 2428 | 4263 | 3577 |
| CD Tensile Strength g/in | 1470 | 4620 | 1771 | 2329 |
| MD Elongation - % | 268 | 187 | 233 | 289 |
| CD Elongation - % | 390 | 234 | 336 | 330 |
| MD Stress Relaxation - % | 31 | 41 | 37 | 43 |
| CD Stress Relaxation - % | 33 | 39 | 43 | 48 |

Stress relaxation was measured by extending the fabric to 50% gauge length and holding the sample for 5 min. while observing the stress decay. The percent stress relaxation is (1−final stress/initial stress)×100%. An Instron Tensile testing device was used to measure stress vs. strain for elastomeric nonwoven spunlaid fabrics. Basis weight of the fabric was determined from the weight of the actual punched-out sample or an average weight of many large pieces taken from a production roll.

EXAMPLE 5

Three elastic bicomponent spunbonded fabrics were prepared using extrusion methods similar to those of Example 1. All three fabrics were formed from 4.0 denier sheath/core bicomponent filaments of composition 5/95 Arco 40-7956X polypropylene/PELLETHANE 2103-70A polyurethane. The fabrics were thermal point bonded at 110 degrees Centigrade. Specimen 1 was tested without any stretch activation. Specimen 2 was stretch activated by passing it once through a ring roller. Specimen 3 was stretch activated by passing it twice in the same direction though a ring roller. The ring roller was equipped with 17 parallel rings per inch with a depth of roller engagement of 0.16". The effect of stretch activation was to decrease the force required to elongate the specimen. The force required to elongate Specimen 1 to 100% was 2.4 kgf/in (kilograms force per inch). The force required to elongate Specimen 2 to 100% was 1.8 kgf/in. The force required to elongate Specimen 3 to 100% was 1.6 kgf/in. The decrease in initial modulus with successive stretch activation steps is indicative of the stretch activation of previously unactivated strands within the various webs during each successive ring rolling.

EXAMPLE 6

Two elastic bicomponent spunbonded fabrics were prepared using extrusion methods similar to those of Example 1. Both fabrics were formed from 7 denier tipped trilobal filaments similar to those described in FIG. 1C. The polymer in the central portion of the filament was Vector 4111. The polymer located on the tips was Dow ASPUN 6811A LLDPE. The fabrics were thermal point bonded at 69 degrees Centigrade. Specimen 1 was tested without stretch activation. Specimen 2 was stretch activated by passing it through a ring roller twice. The ring roller was equipped with 17 parallel rings per inch with a depth of roller engagement of 0.16". The effect of stretch activation was different from the effect observed in Example 5. The force required to elongate Specimens 1 and 2 to 100% was 1.4 kgf/in. However, the force to elongate Specimen 3 to 100% was 0.1 kgf/in. In this case, two passes through the ring roller were required to stretch the relatively thick outer layer of polyethylene. The effect of stretching on filament geometry was evident from scanning electron micrographs. In particular, the filaments in Specimen 1 were relatively straight whereas filaments in Specimen 3 were highly kinked and crenulated. The highly crenulated shape of the filaments contributes to the elasticity of the fabric. The recovery of Specimen 1 from 100% elongation was 60%. The recovery of Specimen 2 from 100% elongation was 90%.

EXAMPLE 7

Three elastic bicomponent spunbonded fabrics were prepared using extrusion methods similar to those of Example 1. All three fabrics were formed from 8 denier sheath/core bicomponent filaments. The core polymer, which constituted 95% of the filament, was Dow 58200.02 PE elastomer. The sheath polymer, which constituted 5% of the filament, was a 85/15 blend of Dow 6811A LLDPE/PP homopolymer. The filament webs were bonded at 110° C. Specimen 1 was tested without any stretch activation. Specimen 2 was stretch activated by passing it through a ring roller. Specimen 3 was stretch activated by passing it twice in the same direction through a ring roller. The ring roller was equipped with 17 parallel ring per inch with a depth of roller engagement of 0.16". The effect of stretch activation was to decrease the force required to elongate the specimen. The force required to elongate Specimen 1 to 100% was 1.0 kgf/in. The force required to elongate Specimen 2 to 100% was 0.6 kgf/in. The force required to elongate Specimen 3 to 100% was 0.4 kgf/in.

What is claimed is:

1. A method for producing an elastic nonwoven fabric, comprising:

incrementally stretching a nonwoven web in at least one direction to activate the elastic properties of the nonwoven web and to form the elastic nonwoven fabric, wherein the nonwoven web comprises a plurality of multicomponent strands having first and second polymer components longitudinally coextensive along the length of the strands, said first component comprising an elastomeric polymer, and said second polymer component comprising a polymer less elastic than the first polymer component.

2. The method according to claim 1, wherein the nonwoven web is formed by:

melt spinning a plurality of multicomponent strands having first and second polymer components longitudinally coextensive along the length of the strands, said first component comprising an elastomeric polymer, and said second polymer component comprising a non-elastomeric polymer;

forming the multicomponent strands into a nonwoven web; and bonding or intertwining the strands to form a coherent bonded nonwoven web.

3. The method according to claim 1, wherein the step of incrementally stretching the web comprises stretching the fabric so that portions of the multicomponent strands are stretch-activated and become elastic, while other portions of the strands are not stretch-activated and are substantially less elastic.

4. The method according to claim 1, wherein the incrementally stretching the web comprises stretching the fabric so that substantially all of the multicomponent strands are stretch-activated and become elastic.

5. The method according to claim 1, wherein the incrementally stretching the web comprises incrementally stretching the web in both the machine direction and in the cross-machine direction.

6. The method according to claim 1, wherein the incrementally stretching the web comprises directing the web through at least one pair of interdigitating stretching rollers.

7. The method according to claim 5, wherein the directing the web through interdigitating stretching rollers includes forming narrow, spaced apart longitudinally extending stretch-activated elastic zones in the fabric, separated by intervening longitudinally extending non-activated zones that are substantially less elastic.

8. The method according to claim 1, wherein the incrementally stretching the web comprises directing the web through a first pair of interdigitating stretching rollers to stretch activate at a first portion of the web and subsequently directing the web through a second pair of interdigitating stretching rollers to stretch activate a second portion of the non-activated strands within the web.

9. The method according to claim 1, wherein the first polymer component comprises an elastomeric polyurethane, elastomeric polyethylene, elastomeric polypropylene or blends thereof, and the second polymer component comprises a polyolefin that is less elastic than the elastomeric polyurethane.

10. The method according to claim 1 wherein the second polymer component is polypropylene, polyethylene, or a blend thereof.

11. The method according to claim 1, wherein at least a portion of the multicomponent strands has a sheath/core configuration.

* * * * *